US007487654B2

(12) United States Patent
Lefavour et al.

(10) Patent No.: US 7,487,654 B2
(45) Date of Patent: Feb. 10, 2009

(54) HYDRAULIC TOOL WITH TACTILE FEEDBACK

(75) Inventors: John D. Lefavour, Litchfield, NH (US); Armand T. Montminy, Manchester, NH (US)

(73) Assignee: FCI Americas Technology, Inc., Carson City, NV (US)

( * ) Notice: Subject to any disclaimer, the term of this patent is extended or adjusted under 35 U.S.C. 154(b) by 1 day.

(21) Appl. No.: 11/893,248

(22) Filed: Aug. 15, 2007

(65) Prior Publication Data

US 2008/0087064 A1 Apr. 17, 2008

Related U.S. Application Data

(60) Provisional application No. 60/851,724, filed on Oct. 13, 2006.

(51) Int. Cl.
*B21D 39/00* (2006.01)
*B21J 9/14* (2006.01)

(52) U.S. Cl. ..... 72/31.01; 72/453.15; 72/21.3; 72/21.6; 72/453.16; 30/180; 29/720; 29/751

(58) Field of Classification Search . 72/453.15–453.19, 72/21.3, 31.01, 307; 30/180; 29/243.53, 29/720, 751, 243.525
See application file for complete search history.

(56) References Cited

U.S. PATENT DOCUMENTS

| | | | | |
|---|---|---|---|---|
| 2,388,462 | A | 11/1945 | Beeh | 103/173 |
| 2,444,550 | A | 7/1948 | Ashton | 103/223 |
| 2,737,168 | A | 3/1956 | Chandler | 123/140 |
| 4,120,188 | A * | 10/1978 | Schwab | 29/243.525 |
| 4,236,878 | A | 12/1980 | Terauchi | 417/269 |
| 4,240,280 | A | 12/1980 | Foslien | |
| 4,494,398 | A * | 1/1985 | Svoboda | 72/393 |
| 4,823,588 | A * | 4/1989 | Bussereau et al. | 72/453.06 |
| RE33,714 | E | 10/1991 | Anderson et al. | |
| 5,152,162 | A * | 10/1992 | Ferraro et al. | 72/16.8 |
| 5,195,042 | A | 3/1993 | Ferraro et al. | |
| 5,437,177 | A | 8/1995 | Orcutt et al. | |
| 5,472,322 | A | 12/1995 | Huet et al. | 417/415 |
| 5,553,478 | A * | 9/1996 | Di Troia | 72/453.15 |
| 5,727,417 | A | 3/1998 | Moffatt et al. | 72/453.03 |
| 5,789,038 | A | 8/1998 | Ono | 427/437 |
| 6,162,024 | A | 12/2000 | Bruzek | 417/222.1 |
| 6,264,437 | B1 | 7/2001 | Porel | 417/390 |
| 6,398,763 | B1 | 6/2002 | Richardson et al. | 604/218 |
| 6,446,482 | B1 | 9/2002 | Heskey et al. | 72/453.16 |
| 6,453,719 | B1 | 9/2002 | Heskey et al. | 72/453.16 |
| 6,564,610 | B2 * | 5/2003 | Lefavour et al. | 72/453.16 |
| 6,745,611 | B2 * | 6/2004 | Lefavour et al. | 72/453.15 |
| 6,834,524 | B2 * | 12/2004 | Johnston | 72/453.16 |
| 7,111,488 | B2 * | 9/2006 | Lefavour et al. | 72/453.16 |
| 7,124,608 | B2 * | 10/2006 | Goop | 72/31.01 |
| 7,165,439 | B2 * | 1/2007 | Lefavour et al. | 72/453.16 |
| 2004/0242996 | A1 | 12/2004 | Trombley, III et al. | 600/432 |
| 2006/0156786 | A1 | 7/2006 | Lefavour et al. | |

OTHER PUBLICATIONS

U.S. Appl. No. 11/429,039, filed May 2006, Montminy et al.

* cited by examiner

*Primary Examiner*—David B Jones
(74) *Attorney, Agent, or Firm*—Harrington & Smith, PC

(57) ABSTRACT

A hydraulic tool including a frame having a hydraulic fluid conduit system; a hydraulic pump coupled to the conduit system; and a tactile feedback system. The tactile feedback system is coupled to the conduit system and is adapted to signal a user of an occurrence of a predetermined event.

21 Claims, 8 Drawing Sheets

HYDRAULIC TOOL WITH TACTILE FEEDBACK

CROSS REFERENCE TO RELATED APPLICATION

This application claims priority under 35 U.S.C. §119(e) to U.S. provisional patent application No. 60/851,724 filed Oct. 13, 2006 which is hereby incorporated by reference in its entirety.

BACKGROUND OF THE INVENTION

1. Field of the Invention

The invention relates to a hydraulic tool and, more particularly, to a tool having a tactile feedback system.

2. Brief Description of Prior Developments

Battery powered hydraulic crimp tools are known. Some battery powered hydraulic crimp tools have a system for generating an audible sound, such as a "pop" when a predetermined hydraulic pressure is reached. This can be used to signal a user that a good crimp has been obtained. This sound can be generated by a pressure relief valve opening.

There is a problem with this type of audible system in that, if the audible pop is not very loud or non-existent, then the user may not realize that the crimp pressure was achieved. If the user continues to operate the tool motor without further crimping action, the battery will be drained unnecessarily. It is, therefore, desirable to provide an alternate type of feedback to the user which indicates that a predetermined crimp pressure was achieved so the user can stop the tool and thereby prevent unnecessary use of the battery (and premature draining of the battery). This is particularly desired in a noisy environment.

SUMMARY OF THE INVENTION

In accordance with one aspect of the invention, a hydraulic tool is provided including a frame having a hydraulic fluid conduit system; a hydraulic pump coupled to the conduit system; and a tactile feedback system. The tactile feedback system is coupled to the conduit system and is adapted to signal a user of an occurrence of a predetermined event.

In accordance with another aspect of the invention, a hydraulic tool is provided including a frame having a hydraulic fluid conduit system; a hydraulic pump coupled to the conduit system; and a signaling system. The signaling system is coupled to the conduit system for signaling a user of an occurrence of a predetermined event. The signaling system is adapted to generate at least two different signals to the user.

In accordance with another aspect of the invention, a method for signaling a user of a hydraulic tool of an occurrence of a predetermined event is provided including allowing hydraulic fluid to pass through a valve of the tool upon the occurrence of the predetermined event; and generating a tactile sensation to a hand of the user holding the tool based upon the hydraulic fluid passing through the valve.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
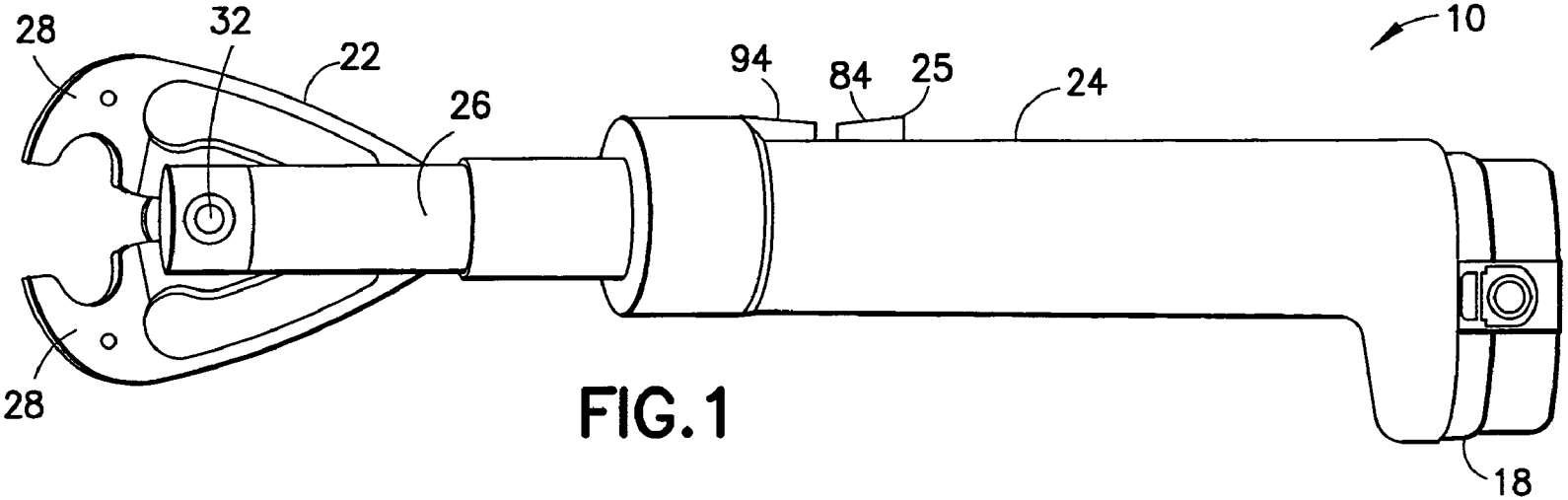
FIG. 1 is an elevational side view of a battery operated, hydraulic tool incorporating features of the invention.

Referring to FIG. 1, there is shown an elevational side view of a tool 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

The tool 10 is a hand-held hydraulically operated, battery powered tool. However, features of the invention could be used in a non-battery operated tool. The tool 10 is a crimping tool for crimping an electrical connector onto a conductor, such as an electrical cable for example. However, features of the invention could be used in any suitable type of hydraulically operated tool, such as a cutting tool for example.

Figure 2:
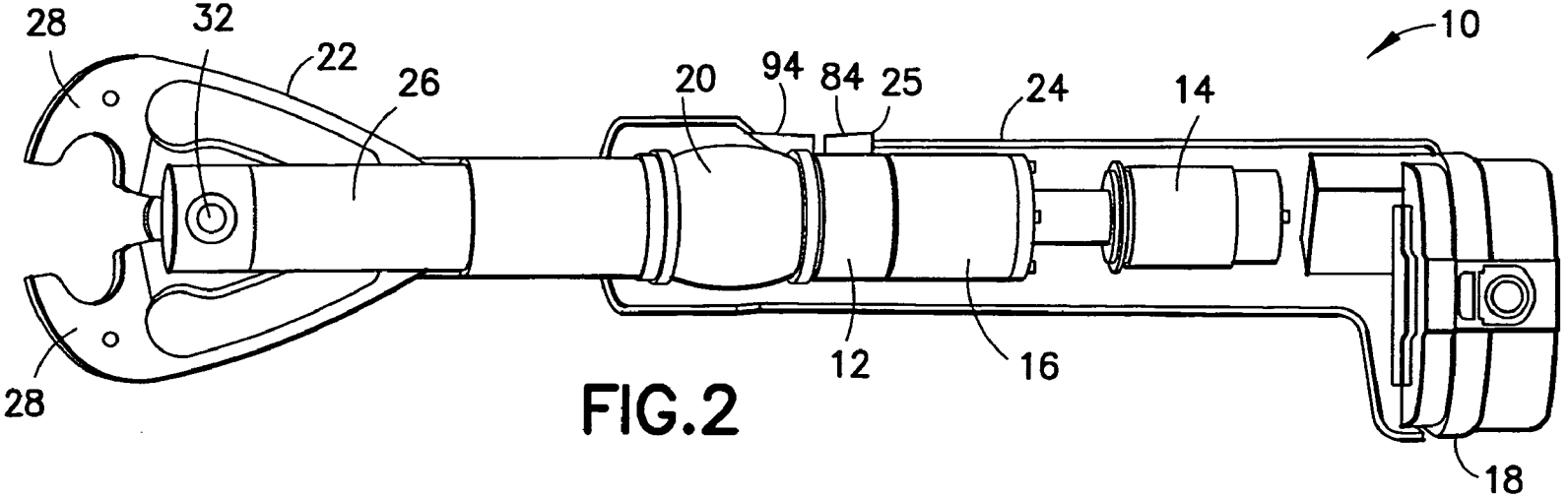
FIG. 2 is a side view of the tool shown in FIG. 1 with a cut away view of the housing.

Referring also to FIG. 2, the tool 10 generally comprises a pump 12, a motor 14, a transmission 16 connecting the motor to the pump, a battery 18, a fluid reservoir 20, a working head 22, and a housing 24. The tool 10 has a user actuated control 25, such as push buttons or a rocker switch for example. However, in alternate embodiments, any suitable type of user actuated control could be provided. The working head 22, in this embodiment, comprises a frame 26, two jaws 28 and rollers 30 (see FIG. 4). However, in alternate embodiments any suitable type of working head could be provided. The jaws 28 are pivotably connected to the frame 26 at a pivot connection 32. The front ends of the jaws are adapted to removably receive crimping dies. However, in an alternate embodiment, the working head could be a die-less crimping head. The rollers 30 are located against the rear ends of the jaws 28; and can be pushed between the rear ends of the jaws. The pivot connection 32 could be assisted by an extension spring in jaw holes (see FIG. 6 for example) to bias the jaws 28 towards an open position when the ram 34 (see FIG. 4) is in a rearward position.

Figure 3:
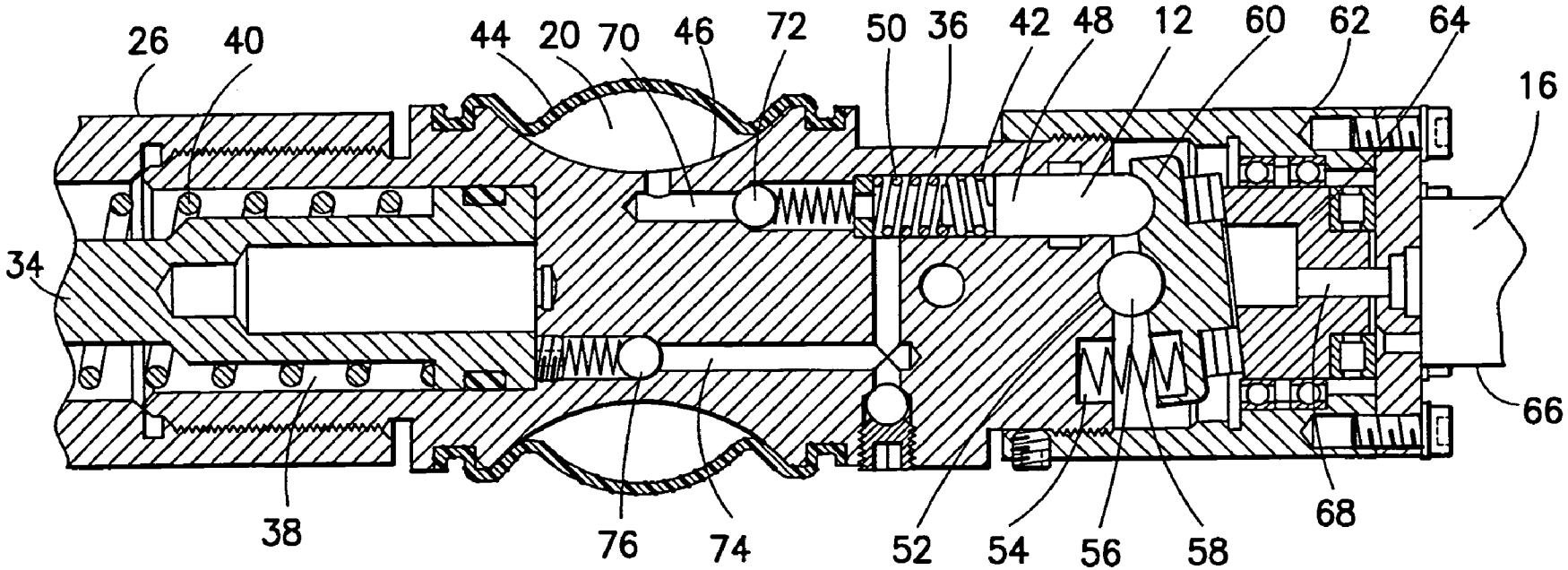
FIG. 3 is a partial cross sectional view of some of the components of the tool shown in FIGS. 1 and 2.
Figure 4:
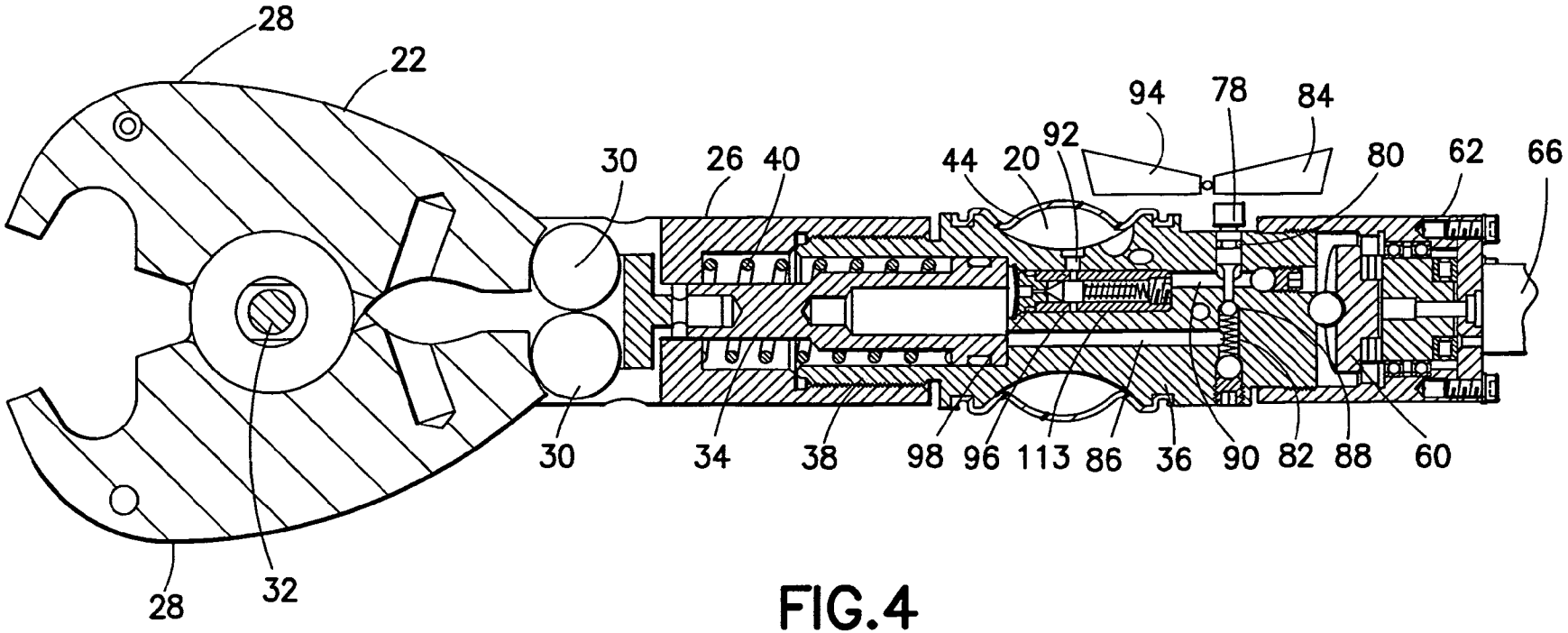
FIG. 4 is a partial cross sectional view of some of the components of the tool shown in FIGS. 1 and 2.

Referring also to FIGS. 3 and 4, the pump 12 could comprise any suitable pump. However, in this embodiment the pump is a wobble plate pump such as described in U.S. patent application Ser. No. 11/429,039 which is hereby incorporated by reference in its entirety. The pump 12 comprises a frame 36. The frame 36 has a front end which forms a ram cylinder 38. The ram 34 is located in the ram cylinder 38 and biased towards a rearward position by a ram spring 40. The front end of the ram 34 is located against the rollers 30. The ram 34 can be moved forward by hydraulic fluid to move the rollers 30 forward and, thus, spread the rear ends of the jaws 28 apart. This causes the front ends of the jaws to be moved towards each other.

The frame 36 forms hydraulic conduits from a piston channel 42 to the rear end of the ram at the ram cylinder 38. Various check valves and a release and/or relief valve are also preferably located in the hydraulic conduits. An exterior side of the frame 36 also forms part of the reservoir 20. A bladder 44 is attached at an annular recess 46 of the frame 36 to form the reservoir 20. However, in an alternate embodiment any suitable type of hydraulic fluid reservoir or hydraulic fluid supply could be provided.

The pump 12 comprises a piston pump member 48 located in the piston channel 42. The piston pump member 48 extends out of the rear end of the frame 36 and is biased outward by a spring 50. The piston member 48 is arranged in the piston channel 42 for reciprocating forward and backward movement. As the piston member 48 moves rearward it draws hydraulic fluid into the piston chamber 42 from the reservoir 20 through the conduit 70 and past check valve 72. As the piston member 48 moves forward, it pushes that hydraulic fluid towards the ram cylinder 38 through conduit 74 and past check valve 76.

The rear end of the frame 36 comprises a pivot member hole 52 and at least one spring hole 54. A pivot member 56 is pivotably located in the hole 52. In this embodiment the pivot member 56 is a ball. However, in alternate embodiments any suitable pivotable connection of the wobble plate 60 to the rear end of the frame 36 could be provided. A spring 58, such as a coil spring, is located in each of the holes 54. In this embodiment only one coil spring 58 is provided. However, in alternate embodiments two to five or more coil springs could be provided. The spring 58 is located on an opposite side of the rear end of the frame 36 from the piston member 48 with the pivot member 56 therebetween.

The transmission 16 generally comprises the wobble plate 60, a transmission case 62, a bevel disk 64 and a gearbox 66. The gearbox 66 is connected to an output shaft of the motor 14. The bevel disk 64 is connected to an output shaft 68 of the gearbox 66. The front end of the bevel disk 64 has an angled front face. The face is angled relative to the center axis. The front end also comprises a counter balance pocket.

The user interface or control 25 includes an activation lever 94 pivotably connected to the frame 36 or the housing 24. The lever 94 is preferably biased by a spring in an outward position. However, in alternate embodiments, any suitable type of user activation control could be provided. When the lever 94 is depressed by a user, the motor 14 is activated.

As seen in FIG. 4, the tool 10 includes a hydraulic fluid release system 78. The release system 78 generally comprises a drain pin 80, a drain valve 82, and a retract lever 84. The retract lever 84 is part of the user interface 25. The release system 78 uses these members in combination with the conduits 86, 88, 90, 92 to release hydraulic fluid from the ram cylinder 38 back into the reservoir 20. The drain valve 82 has a spring for biasing the drain valve in a closed position. The Drain pin 80 has an end which extends out of the frame 36. The retract lever 84 is pivotably connected to the frame 36 or the housing 24. The lever 84 may be biased by a spring against the outer end of the drain pin 80. However, the lever 84 is preferably biased on the housing 24 away from the drain pin 80. The spring of the drain valve 82 is stronger than the spring of the lever 84. However, the lever can move both inward and outward from a home position shown in FIG. 4. The lever 84 can be depressed by a hand or finger of a user to move the drain pin 80 inward. This can unseat the drain valve 82 and, therefore, open the drain valve 82 to allow release of hydraulic fluid from the ram cylinder 38 back into the reservoir 20. This allows the ram 34 to retract rearward, which causes the crimp jaws to open.

Figure 5:
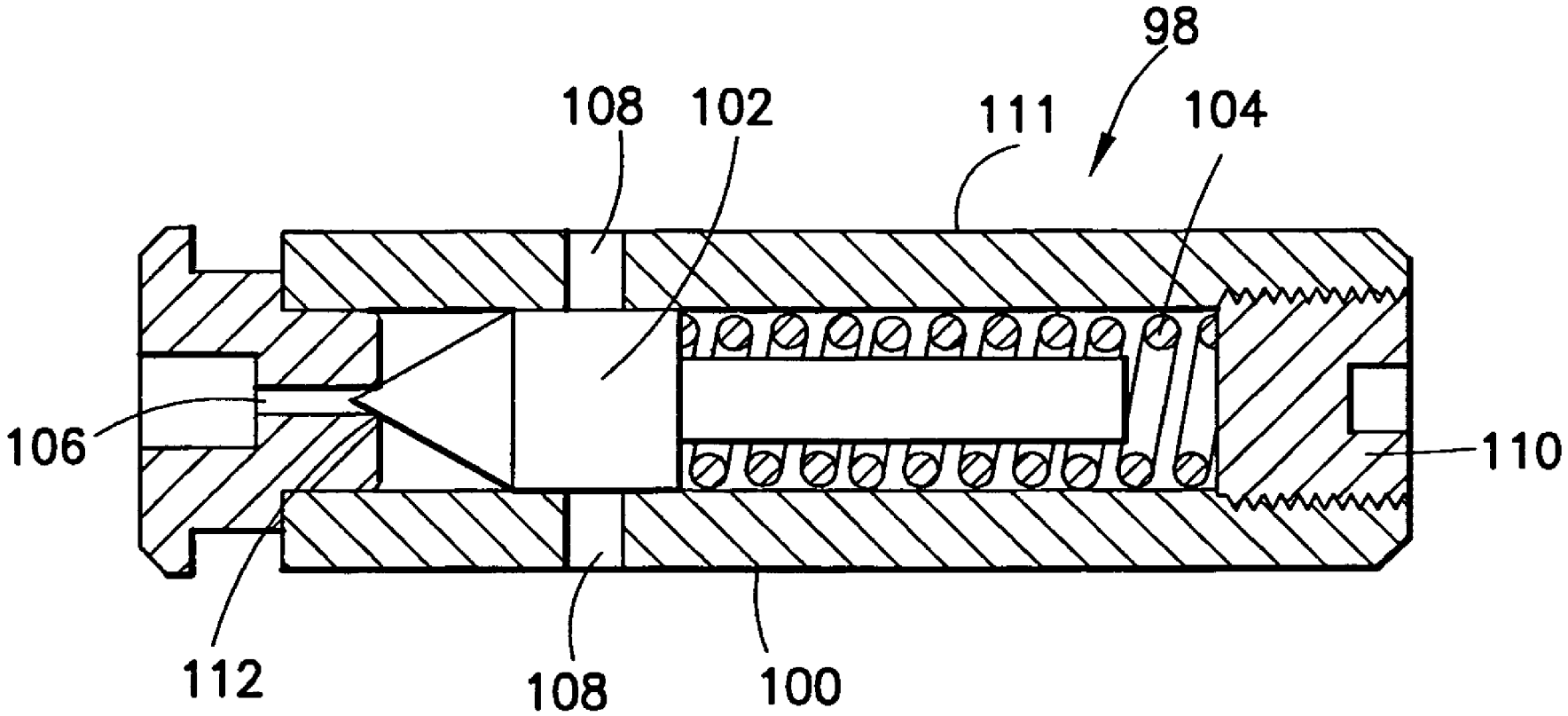
FIG. 5 is an enlarged cross sectional view of the relief valve shown in FIG. 4.

The tool 10 also includes a hydraulic fluid relief system 96. The relief system 96 generally comprises a relief valve 98 connected to the conduit system of the frame 36 between the ram cylinder 38 and the reservoir 20. In this embodiment the relief valve 98 is mounted in the conduit 90 proximate the conduit 92. Referring also to FIG. 5, the relief valve 98 generally comprises a valve body 100, a valve cone 102 and a spring 104. The valve body 100 includes an inlet port 106, outlet ports 108, an adjusting screw 110, and a reduced outer diameter section 111. The valve cone 102 is movably located in the valve body. The spring 104 biases the valve cone 102 into sealing contact with the valve seat 112 formed at the inlet port 106.

When hydraulic pressure in the ram cylinder 38 reaches a predetermined value, the front of the valve cone 102 is unseated from the valve seat 112 (due to hydraulic pressure at the inlet port 106) and hydraulic fluid is allowed to flow from the ram cylinder 38, through the inlet port 106, out the outlet port 108 and back to the reservoir 20 through conduit 92. If the predetermined pressure is not reached, the relief valve 98 remains closed. The relief valve 98 may be adapted to generate an audible sound, such as a "pop" when it is opened. The relief valve 98 could also be adapted to stay open until a predetermined lower hydraulic pressure is reached.

In addition to the audible signaling system noted above, the tool 10 includes a second signaling system comprising a tactile feedback system. In this embodiment the tactile feedback system comprises the lever 84, the drain pin 80 and the spring of the lever 84. The tactile feedback system is coupled to the conduit system and is adapted to signal a user of an occurrence of a predetermined event. For example, the predetermined event could be the relief valve 98 being actuated or a predetermined hydraulic pressure being reached.

The tactile feedback system provides tactile feedback to a hand of a user because the hand of the user will be contacting the lever 84 while the user is actuating the lever 94. More specifically, when the valve 98 opens, some of the hydraulic fluid from the ram cylinder 38 will be pushed into the conduit 90 and push the drain pin 80 outward. The lever 84 will move outward with the spring of the lever 84 being deflected. When the valve 98 closes again, the spring of the lever 84 will move the lever back to its home position; back inward. Because of the reciprocating motion of the piston pump member 48, the valve 98 can also be adapted to repeatedly open and close until the user stops actuating the lever 94. Thus, the tactile feedback system, in this embodiment, will result in the lever 84 moving up and down in a type of vibratory effect on the user's hand; because the valve 98 will repeatedly open and close. However, in an alternate embodiment the tactile feedback might not be vibratory. For example, the tactile feedback could comprise only one tactile jolt type of signal. This could be accompanied by an audible "pop" as noted in the alternate embodiment described below.

In the embodiment described above, the tool has a signaling system for signaling a user of an occurrence of a predetermined event and, more specifically, the signaling system is adapted to generate at least two different signals to the user. In the embodiment described, the two signals include an auditory signal and a tactile signal. However, in alternate embodiments, more that two types of signals could be provided, and the signals could include signals other than auditory and/or tactile, such as visual for example. In another type of alternate embodiment, only a tactile signaling system might be provided.

The invention can relate to a battery powered hydraulic crimp tool. The invention can provide tactile feedback to the operator which indicates that a crimp is complete. Tactile feedback can be generated once the tool's predetermined relief valve set pressure has been achieved.

With the embodiment described above, the battery powered hydraulic crimp tool 10 can be powered by a DC battery 18 coupled to a DC motor 14 which has an output shaft coupled to a gearbox 66 which also has an output shaft. As the shaft rotates, the bevel disk 64 rotates which rotates on a thrust bearing and transfers rotary motion into linear motion of the wobble plate 60. This activity causes the pump 12 and pump spring to reciprocate. This reciprocating motion pumps hydraulic fluid from the reservoir 20 to the rearward section of the piston ram 34. As the pump moves in a direction toward the rear of the tool 10, fluid is drawn from the reservoir 20 through the inlet check valve 72. As the pump moves in a direction towards the front of the tool 10, fluid is pushed through the outlet check valve 76 and behind the piston ram 34 into the cylinder 38. As fluid fills the cylinder 38, the piston ram 34 advances towards the front of the tool 10 forcing the carrier and rollers 30 onto the cam surface of the jaws 28. As this happens the jaws 28 close and the crimp groove or dies (not shown) crimp the work piece.

Pressure in the cylinder 38 will rise to a predetermined relief valve set pressure. As pressure rises in the cylinder port, the relief valve 98 is subjected to the same pressure as the cylinder 38. When the pressure is at the predetermined valve set pressure, the valve cone 102 lifts off of the valve seat 112 and the cone 102 shuttles away from port 106 and allows fluid to pass through ports 108 back to the reservoir 20. As this happens some fluid is permitted to pass over the valve body at a small diameter annular passageway 113 created by reduced outer diameter section 111 and into the conduit holding the drain pin 80.

The resulting hydraulic pressure in the conduit holding the drain pin 80 is much lower than the hydraulic pressure in the cylinder 38 because the majority of escaping fluid is channeled to the reservoir 20. However, there is still ample pressure to push on the drain pin 80. The pressure that is applied to the drain pin 80 happens over a very small period of time and causes the drain pin 80 to shuttle in a direction opposite to the drain valve 82. The drain valve spring is sized to be relatively stiff and the pressure pulse into conduit holding the drain pin 80 cannot provide enough force to move this spring; so the drain valve 82 remains closed. As the drain pin 80 shuttles in a direction opposite to the drain valve 82, it bumps the retract trigger 84 which provides the tactile feedback to the operator that the predetermined relief valve pressure setting is achieved and, therefore, the crimp is complete.

In addition it should also be noted that an operator can abort the crimp cycle at any point in time by simply activating the retract lever 84 and depress the drain pin 80; thus actuating the drain valve 82. When this occurs fluid is allowed to drain from the cylinder 38 through conduits, through the drain valve 82, and through the annular passageway at the valve 98 back to the reservoir 20. This activity will cause the crimp jaws to open.

In one type of alternate embodiment the pump could be provided outside of the tool. In another type of alternate embodiment, the tool could be a pneumatic tool rather than a hydraulic tool. Preferably the tool is portably hand held, but in an alternate embodiment only a portion of the tool might be held by a hand of the user.

Figure 6:
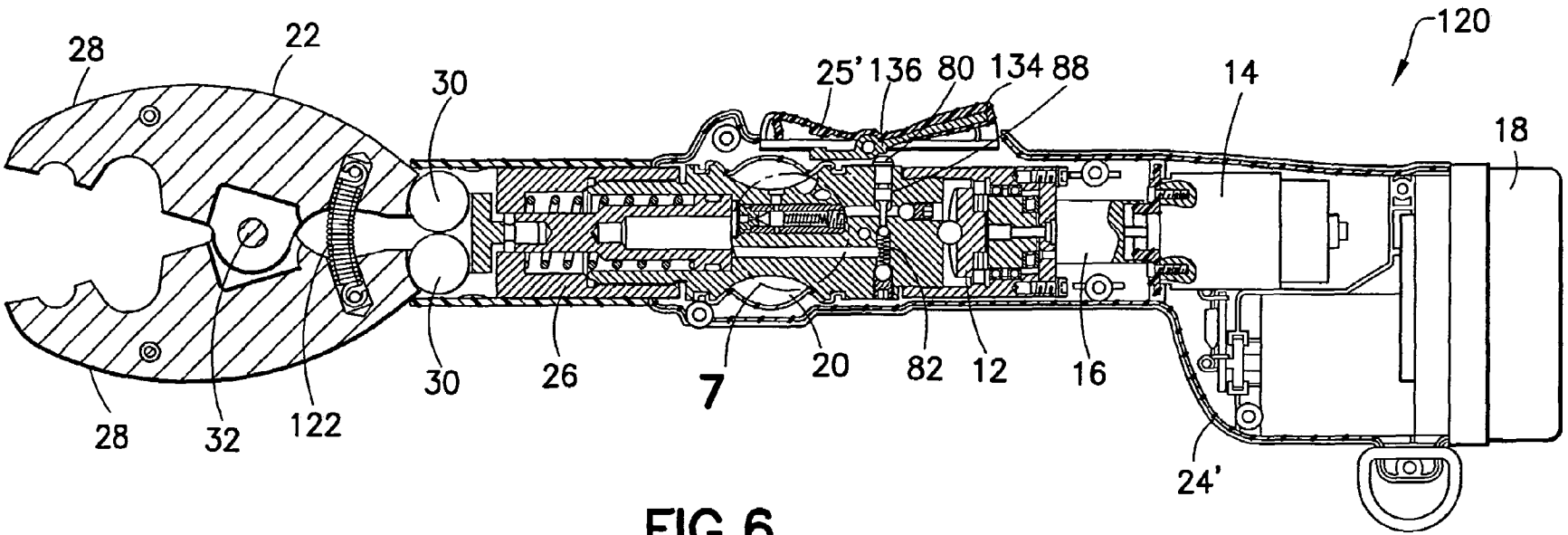
FIG. 6 is a cross sectional view of an alternate embodiment of the tool shown in FIG. 1-5.
Figure 7:
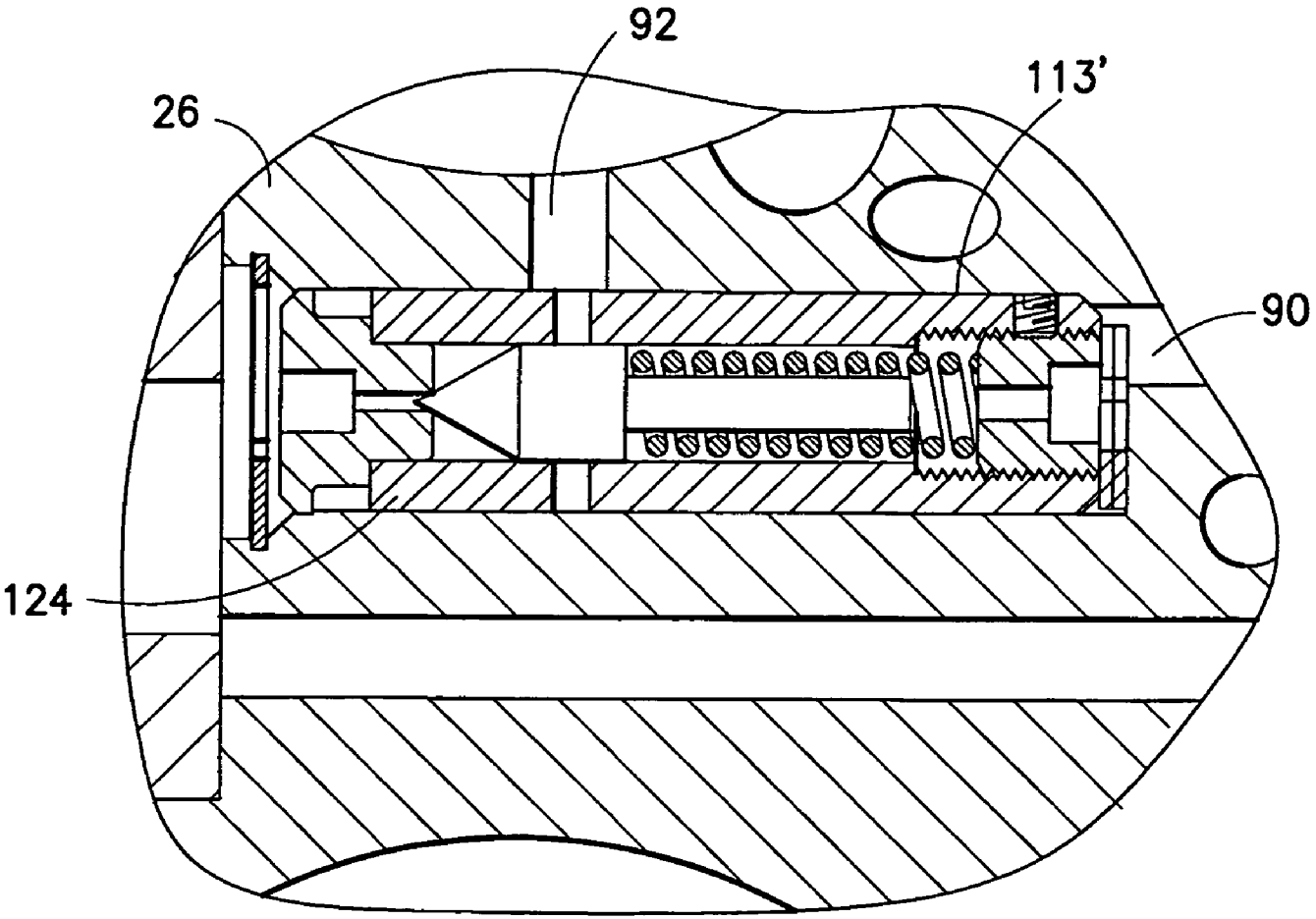
FIG. 7 is an enlarged view of area A shown in FIG. 6.
Figure 8:
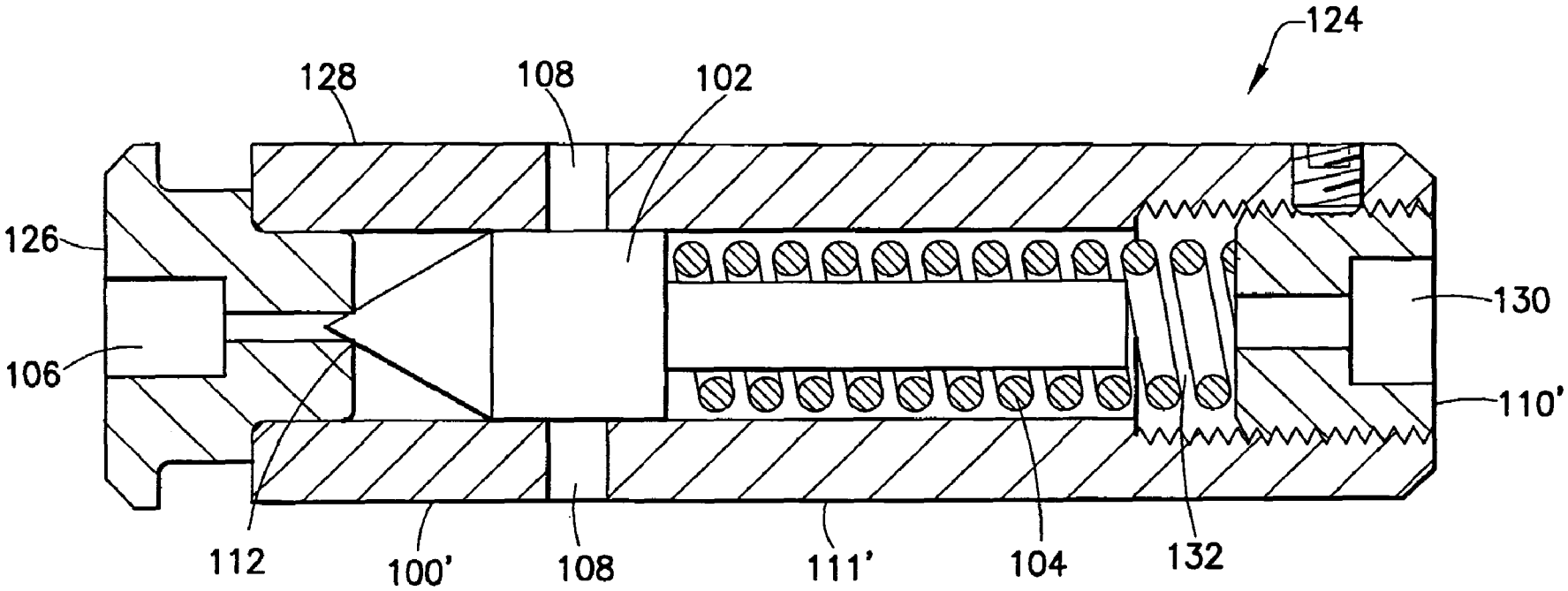
FIG. 8 is an enlarged cross sectional view of the relief valve shown in FIGS. 6-7.

Referring now to FIGS. 6-8, one type of alternate embodiment of the hydraulic tool is shown. In this embodiment the tool 120 generally comprises a pump 12, a motor 14, a transmission 16 connecting the motor to the pump, a battery 18, a fluid reservoir 20, a working head 22, and a housing 24'. The tool 10 has a user actuated control 25' comprising a rocker switch assembly. However, in alternate embodiments, any suitable type of user actuated control could be provided. The working head 22, in this embodiment, comprises a tension spring 122 mounted in holes of the jaws 28 to bias the rear ends of the jaws 28 towards each other. However, in alternate embodiments any suitable type of working head could be provided. The jaws 28 are pivotably connected to the frame 26 at a pivot connection 32. The rollers 30 are located against the rear ends of the jaws 28; and can be pushed between the rear ends of the jaws 28.

The frame 26 and its hydraulic conduits, and check valves in the frame 26 are the same as shown and described with regard to FIGS. 1-5. However, the relief valve is different. As can be seen with greater detail in FIGS. 7 and 8, the relief valve 124 generally comprises a valve body 100', a valve cone 102 and a spring 104. The valve body 100' includes a front member 126 with the inlet port 106, a main member 128 with outlet ports 108, and an adjusting screw 110'. The valve cone 102 is movably located in the valve body 100'. The spring 104 biases the valve cone 102 into sealing contact with the valve seat 112 formed at the rear of the inlet port 106. The valve body 100' has a reduced outer diameter section 111'. In the embodiment shown in FIG. 5, the reduced outer diameter section 111 extends from the rear of the valve body to a location behind the outlet ports 108. In this embodiment, the reduced outer diameter section 111' extends from the rear end of the main member 128 to a location in front of the outlet ports 108. Thus, the annular passage 113' formed between the frame 26 and the valve 124 extends to the conduit 92.

The adjusting screw 110' is screwed into the rear end of the main member 128 and has the rear end of the spring 104 thereagainst. Adjusting the location of the screw 110' relative to the main member 128 adjusts the force exerted by the spring 104 against the valve cone 102. Unlike the screw 110, the screw 110' has an aperture 130 extending through the screw 110'. This aperture 130 is provided to enhance the hydraulic effect of the cone 102 being moved open on the drain pin's 80 tactile feedback signal. In particular, as the valve cone 102 is moved backwards (when it is opened at a predetermined hydraulic pressure) hydraulic fluid in area 132 is pushed out of the aperture 130 into the conduits 90, 88 to very quickly and abruptly push the drain pin 80 to its outward position. The pin 80, in turn, pushes the release lever section 134 of the user control 25' outward very quickly and abruptly. This causes a jolt on the user's hand by the release lever section 134.

In this embodiment, the jolt is a single signal; not a repetitive type of vibration signal. However, the intensity of the jolt is sufficient to clearly be noticed by the user; preferably even if the user is wearing gloves. In this embodiment, the signal is a single signal rather than vibratory. Movement of the hydraulic fluid from the area 132 causes the drain pin 80 to move outward. Movement of hydraulic fluid passing through the passage 113' does not significantly assist in the tactile feedback provided by the pin 80 because the hydraulic fluid movement from the area 132 is so much greater. Passage 113' primarily merely provides a path for hydraulic fluid to pass into the conduit 92 when the release valve 82 is manually opened.

In this embodiment, the tactile feedback system also provides an enlarged audio signal regarding the predetermined event. In particular, when the drain pin 80 is at its closed home position, and the user control 25' is actuated to activate the motor 14, the outer end of the drain pin 80 is spaced from the release lever section 134. When the predetermined hydraulic pressure event occurs and the relief valve 124' opens, the fast movement of the drain pin 80 outward causes an impact on a surface 136 of the control 25' that produces an auditory "pop" outside of the frame 26 that is larger than previously provided by the internal "pop" provided in conventional tools. This exterior auditory signal can be complemented or increased by an additional internal "pop" at a same time provided by the drain pin 80 moving outward. Alternatively, the auditory signal could be caused merely internally, such as by the sound of the fast internal hydraulic fluid movement; not external to the frame 26. Thus, the invention can provide an increase volume auditory signal at the same time it provides a tactile signal to the user.

Figure 9:
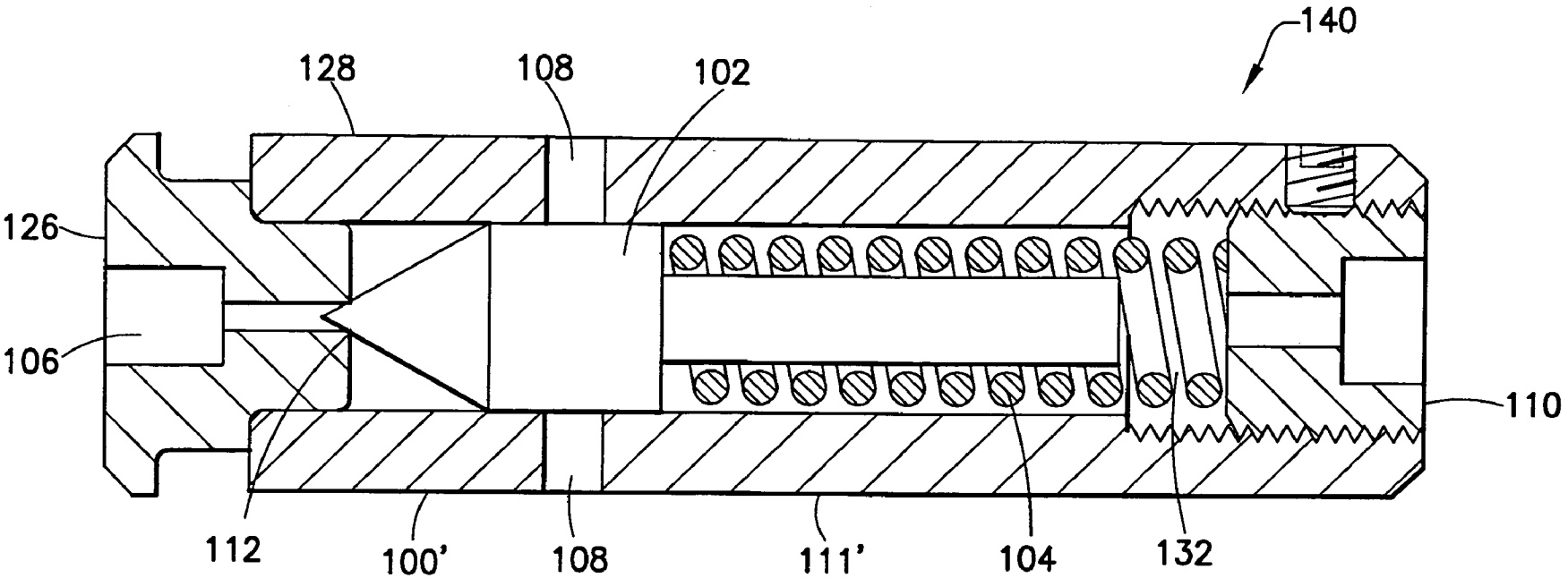
FIG. 9 is a cross sectional view of an alternate embodiment of the relief valve shown in FIG. 8.

Referring also to FIG. 9, an alternate embodiment of the relief valve is shown. In this embodiment, relief valve 140 comprises the valve body 100', the valve cone 102 and the spring 104. The valve body 100' includes the front member 126 with the inlet port 106, the main member 128 with outlet ports 108, and the adjusting screw 110; not the adjusting screw 110'. As noted above, the valve body 100' has a reduced outer diameter section 111'. The reduced outer diameter section 111' extends from the rear end of the main member 128 to a location in front of the outlet ports 108. Thus, the annular passage 113' formed between the frame 26 and the valve 124 extends to the conduit 92.

The adjusting screw 110 is screwed into the rear end of the main member 128 and has the rear end of the spring 104 thereagainst. Adjusting the location of the screw 110 relative to the main member 128 adjusts the force exerted by the spring 104 against the valve cone 102. Unlike the screw 110', the screw 110 does not have an aperture 130 extending through the screw 110. As the valve cone 102 is moved backwards (when it is opened at a predetermined hydraulic pressure), hydraulic fluid in area 132 can move past the sides of the cone 102 out the outlets 108. As the valve cone 102 is moved backwards hydraulic fluid from the valve 140 can be pushed by the pressure of the fluid entering the inlet 106 into the passage 113' to cause the drain pin 80 to be pushed outward. This type of design can alleviate the need to make the aperture 130 in the screw 110, but still provide tactile feedback because of the hydraulic fluid's ability to move from the relief valve 140 towards the drain valve 82 when the relief valve 140 opens. In an alternate embodiment, additional or alternative components of the tool could be used to provide the user with a tactile sensation when a predetermined hydraulic pressure is obtained by a portion of the tool.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A hydraulic tool comprising:

a frame having a hydraulic fluid conduit system;

a user control connected to the frame;

a hydraulic pump coupled to the conduit system; and a tactile feedback system coupled to the conduit system and adapted to signal a user at the user control of an occurrence of a predetermined event.

2. A hydraulic tool as in claim 1 wherein the predetermined event comprises hydraulic pressure in the conduit system reaching a predetermined value.

3. A hydraulic tool as in claim 1 wherein the tactile feedback system comprises at least a portion of a hydraulic fluid release system, wherein the tactile feedback system comprises a drain pin of the release system being located in the conduit system and being adapted to move a user movable retract member of the release system which is connected to the frame or a housing of the tool.

4. A hydraulic tool as in claim 1 wherein the predetermined event comprises hydraulic pressure in the conduit system reaching a predetermined value, and wherein the tactile feedback system comprises a user actuatable trigger adapted to be contacted by a hand of a user.

5. A hydraulic tool as in claim 4 wherein the tactile feedback system comprises at least a portion of a hydraulic fluid release system, wherein the tactile feedback system comprises a drain pin of the release system being located in the conduit system and being adapted to move a user movable retract member of the release system which is connected to the frame or a housing of the tool.

6. A hydraulic tool as in claim 5 wherein the retract member comprises a lever pivotably connected to the frame or the housing and biased by a spring onto or away from the drain pin.

7. A hydraulic tool as in claim 1 wherein the tactile feedback system is adapted to generate a mechanical vibration signal or a mechanical single jolt signal.

8. A hydraulic tool as in claim 1 further comprising a second signal generation system adapted to generate an auditory signal upon the occurrence of the predetermined event.

9. A hydraulic tool comprising:

a frame having a hydraulic fluid conduit system;

a hydraulic pump coupled to the conduit system; and a tactile feedback system coupled to the conduit system and adapted to signal a user of an occurrence of a predetermined event, wherein the tactile feedback system comprises a user actuatable trigger adapted to be contacted by a hand of a user.

10. A hydraulic tool comprising:

a frame having a hydraulic fluid conduit system;

a hydraulic pump coupled to the conduit system; and a signaling system coupled to the conduit system for signaling a user of an occurrence of a predetermined event, wherein the signaling system comprises a movable member having a first end in fluid communication with the conduit system and a second end extending out of the frame, and wherein the signaling system is adapted to generate at least two different signals to the user.

11. A hydraulic tool as in claim 10 wherein a first one of the different signals is a tactile signal to a hand of a user holding the hydraulic tool.

12. A hydraulic tool as in claim 11 wherein a second one of the different signals is an auditory signal.

13. A hydraulic tool as in claim 10 wherein the predetermined event comprises hydraulic pressure in the conduit system reaching a predetermined value.

14. A hydraulic tool as in claim 10 wherein the tactile feedback system comprises a user actuatable trigger adapted to be contacted by a hand of a user.

15. A hydraulic tool as in claim 10 wherein the tactile feedback system is adapted to generate a mechanical repetitive vibration signal or a mechanical single non-repetitive signal.

16. A hydraulic tool comprising:

a frame having a hydraulic fluid conduit system;

a hydraulic pump coupled to the conduit system; and a signaling system coupled to the conduit system for signaling a user of an occurrence of a predetermined event, wherein the signaling system is adapted to generate at least two different signals to the user, and wherein the signaling system comprises a drain pin of a hydraulic fluid release system of the tool being located in the conduit system and being adapted to move a user movable retract member which is connected to the frame.

17. A hydraulic tool as in claim 16 wherein the retract member comprises a lever pivotably connected to the frame or a housing of the tool and biased by a spring onto the drain pin or away from the drain pin.

18. A method for signaling a user of a hydraulic tool of an occurrence of a predetermined event comprising:

allowing hydraulic fluid to pass through a valve of the tool upon the occurrence of the predetermined event; and generating a tactile sensation to a hand of the user holding the tool based upon the hydraulic fluid passing through the valve, wherein generating the tactile sensation to a hand of the user comprises creating a vibration or pulse in the hydraulic tool.

19. A method as in claim 18 wherein the valve comprises an automatic pressure release valve, wherein a portion of the hydraulic fluid passing through the pressure release valve moves a member on the frame.

20. A method as in claim 18 wherein a portion of the hydraulic fluid passing through the valve moves a drain pin of a hydraulic fluid release system to move a user actuatable hydraulic fluid release trigger.

21. A method as in claim 18 further comprising generating an auditory signal by the hydraulic tool upon the occurrence of the predetermined event.

* * * * *